US007854581B2

(12) United States Patent
Kubo et al.

(10) Patent No.: US 7,854,581 B2
(45) Date of Patent: Dec. 21, 2010

(54) BOOKBINDING APPARATUS, BOOKBINDING SYSTEM, AND BOOKBINDING METHOD

(75) Inventors: Masayoshi Kubo, Kashiwa (JP); Hiroki Honmochi, Moriya (JP); Toshiaki Nochi, Joso (JP); Ken Yonekawa, Moriya (JP); Yuji Ueno, Moriya (JP)

(73) Assignee: Canon Finetech Inc., Misato-shi (JP)

( * ) Notice: Subject to any disclaimer, the term of this patent is extended or adjusted under 35 U.S.C. 154(b) by 723 days.

(21) Appl. No.: 11/397,554

(22) Filed: Apr. 5, 2006

(65) Prior Publication Data

US 2006/0249893 A1 Nov. 9, 2006

(30) Foreign Application Priority Data

Apr. 8, 2005 (JP) ..... 2005-111484

(51) Int. Cl.
*B42B 9/00* (2006.01)

(52) U.S. Cl. ..... 412/29; 412/37; 270/58.07

(58) Field of Classification Search ..... 412/1, 412/4, 8, 9, 16, 18, 19, 22–25, 29, 33, 36, 412/37; 270/52.14, 52.17, 52.18, 58.07–58.09, 270/58.12, 58.17; 399/395
See application file for complete search history.

(56) References Cited

U.S. PATENT DOCUMENTS

| | | | | |
|---|---|---|---|---|
| 3,788,921 | A * | 1/1974 | Polit et al. | 156/216 |
| 5,899,649 | A * | 5/1999 | Kohtani et al. | 412/11 |
| 6,739,816 | B1 * | 5/2004 | Schuder et al. | 412/4 |
| 2004/0141830 | A1 * | 7/2004 | Yoshie et al. | 412/1 |
| 2005/0249574 | A1 * | 11/2005 | Honmochi et al. | 412/9 |
| 2007/0023148 | A1 | 2/2007 | Takagi et al. | |

FOREIGN PATENT DOCUMENTS

| | | |
|---|---|---|
| JP | 57-183171 | 11/1982 |
| JP | 11-34536 | 2/1999 |
| JP | 2002-172873 | 6/2002 |
| JP | 2004-209869 | 7/2004 |
| JP | 2004-305879 | 11/2004 |

* cited by examiner

*Primary Examiner*—Dana Ross
*Assistant Examiner*—Pradeep C Battula
(74) *Attorney, Agent, or Firm*—Fitzpatrick, Cella, Harper & Scinto

(57) ABSTRACT

A bookbinding apparatus provided with an accumulating portion, which accumulates sheets into a sheet bundle, a bundle position correcting device, which corrects an adhesive application position of the sheet bundle, an adhesive applying portion, which applies an adhesive to the sheet bundle, and a bookbinding device, which cases the sheet bundle having the adhesive applied thereto in a cover for casing—in a book.

5 Claims, 13 Drawing Sheets

BOOKBINDING APPARATUS, BOOKBINDING SYSTEM, AND BOOKBINDING METHOD

This application claims priority benefits of Japanese Patent Application No. 2005-111484 filed Apr. 8, 2005, the disclosure of which is incorporated herein by reference in its entirety.

BACKGROUND OF THE INVENTION

1. Field of the Invention

This invention relates to a bookbinding apparatus attached to an image forming apparatus such as, for example, a copying machine or a printer for binding sheets into a bundle, a bookbinding system provided with such a bookbinding apparatus, and a bookbinding method applied to the bookbinding apparatus.

2. Description of the Related Art

There is known a bookbinding apparatus which accumulates sheets successively supplied from an image forming apparatus to thereby form a sheet bundle, and thereafter applies an adhesive, particularly hot-melt adhesive, to one end portion of the sheet bundle and cases it in a cover. In such a bookbinding apparatus, the adhesive is applied to one end portion of the sheet bundle and therefore, the positional accuracy of the sheet bundle and an adhesive applying portion becomes very important. That is, unless the parallelism between the two is kept well, there is the high risk of leading to a missing leaf, such as the non-uniform application of the adhesive to the end edge of the sheet bundle. Therefore, as disclosed, for example, in Japanese Patent Application Laid-open No. H11-34536, the milling process of cutting and truing up the edge surface of the sheet bundle to which the adhesive is to be applied is carried out before the application of the adhesive.

However, when the milling process is carried out on the sheet bundle, a great deal of powdery rubbish is produced and therefore, it becomes necessary to provide a rubbish treating apparatus for sucking and treating such rubbish or a rubbish collecting container for collecting the rubbish therein, and this becomes a hindrance to the downsizing of the bookbinding apparatus.

SUMMARY OF THE INVENTION

The present invention has been made in view of such circumstances, and has as an object thereof to provide a bookbinding apparatus which secures the positional accuracy of a sheet bundle and an adhesive applying portion to thereby eliminate the milling process, by a simple construction, a bookbinding system provided with such the bookbinding apparatus, and a bookbinding method applied to the bookbinding apparatus.

In order to achieve the above object, a bookbinding apparatus according to the present invention is provided with an accumulating portion for accumulating sheets and forming them into a sheet bundle, a bundle position correcting device for correcting the adhesive application position of the sheet bundle, an adhesive applying portion for applying an adhesive to the sheet bundle, and a bookbinding device for casing the sheet bundle having the adhesive applied thereto in a cover and casing-in a book.

According to the thus constructed bookbinding apparatus, the securement of the positional accuracy of the conveyed sheet bundle and the adhesive applying portion is coped with not by the milling process which produces rubbish, but by the bundle position correcting device which corrects the adhesive application position of the sheet bundle and therefore, the rubbish treating apparatus for treating the rubbish produced by the milling process or the rubbish collecting container for collecting the rubbish therein becomes unnecessary, and it becomes possible to achieve the downsizing of the bookbinding apparatus.

By attaching such a bookbinding apparatus as described above to an image forming apparatus for forming an image, there is obtained a bookbinding system, which can successively treat sheets having images formed thereon in the image forming apparatus, and as described above, coupled with the downsizing of the bookbinding apparatus, it becomes possible to downsize the entire bookbinding system.

Also, in order to achieve the above-described object, a bookbinding method according to the present invention has the sheet bundle forming step of accumulating sheets and forming them into a sheet bundle, the end portion nipping step of nipping an end portion of the sheet bundle so that the sheet bundle may become rotatable, and the bundle position correcting step of ramming the adhesive applied surface of the sheet bundle nipped by the end portion nipping step against a bundle position reference member to thereby correct so that the adhesive applied surface may be parallel to the bundle position reference member.

According to such a bookbinding method, the accumulated sheet bundle is corrected by the bundle position correcting step so that the adhesive applied surface thereof may be rammed against and be parallel to the bundle position reference member and therefore, it becomes unnecessary to provide the milling process step which produces rubbish and along therewith, the rubbish treating apparatus for treating the rubbish produced by the milling process or the rubbish collecting container for collecting the rubbish therein becomes unnecessary, and it becomes possible to achieve the downsizing of the bookbinding apparatus.

The above and other objects, features and advantages of the present invention will become more apparent upon consideration of the following description of the preferred embodiment of the present invention taken in conjunction with the accompanying drawings.

DESCRIPTION OF THE PREFERRED EMBODIMENT

An embodiment of the present invention will hereinafter be described in detail with reference to the drawings.

Figure 1:
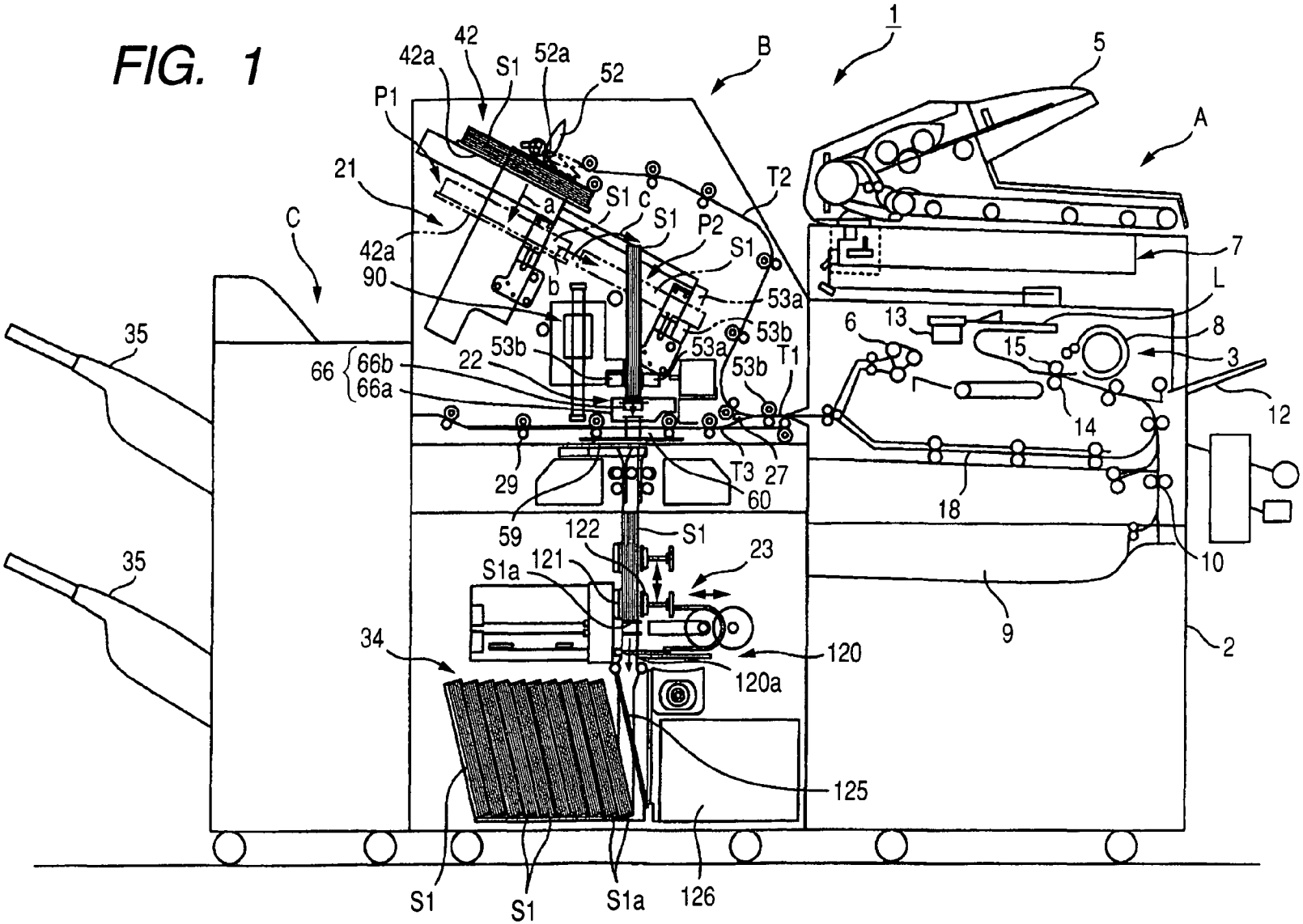
FIG. 1 shows the general construction of a bookbinding system according to an embodiment of the present invention.

FIG. 1 shows a bookbinding system 1 provided with a copying machine A as an image forming apparatus, a bookbinding apparatus B and a post-treatment apparatus C. The bookbinding apparatus B has the function of receiving a plurality of sheets having images transferred thereto from the copying machine A and accumulating the received sheets into a bundle shape to thereby form a sheet bundle, and bookbinding the sheet bundle. The post-treatment apparatus C has a sheet discharge tray 35, and has the function of receiving the plurality of sheets having images transferred thereto from the copying machine A through the bookbinding apparatus B, and forming a sheet bundle and performing post-treatment such as a stapling process (binding process). It is also possible to use the copying machine A and the bookbinding apparatus B singly.

An image forming portion 3 is provided in the apparatus main body 2 of the above-described copying machine A, and by this image forming portion 3, an image is formed on a sheet such as plain paper or an OHP sheet. Specifically, an original feeding apparatus 5 is mounted on the upper surface of the apparatus main body 2, and an original automatically fed from this original feeding apparatus 5 is optically read by an optical reading device 7, and the read information is transmitted as a digital signal to the image forming portion 3. In the image forming portion 3, on the basis of the digital signal, a laser beam L is applied from a light applying device 13 to the surface of a photosensitive drum 15, whereby an electrostatic latent image corresponding to the original is formed on the surface of the photosensitive drum 15. Subsequently, by the rotation of the photosensitive drum 15, a toner is supplied from a developing apparatus 8 disposed around the photosensitive drum 15 to the electrostatic latent image, whereby the electrostatic latent image is visualized. Thereafter, this visualized toner image is transferred to a sheet S conveyed to a transferring portion 14 at predetermined timing. The sheets S to which images are to be transferred are fed one by one from a sheet cassette 9 mounted on the lower portion of the apparatus main body 2 by conveying rollers 10. Of course, the feeding from a multi-tray 12 is also possible.

Thereafter, the sheet S to which the toner image has been transferred in the transferring portion 14 is conveyed to a fixing device 6, where the toner image is permanently fixed by the application of heat and pressure thereto. In a case where in the apparatus main body 2, a one-side mode is set, the sheet S passed through the fixing device 6 is conveyed into the bookbinding apparatus B. On the other hand, in a case where in the apparatus main body 2, a two-side recording mode is set, the sheet S having an image formed on one side thereof is passed through the fixing device 6, and thereafter is first conveyed to a reconveying path 18 by switch back, and then is conveyed again to the image forming portion 3, and an image is formed on the back side thereof, whereafter the sheet S is conveyed into the bookbinding apparatus B.

The apparatus main body 2 is adapted to send a signal such as a sheet size to the bookbinding apparatus B so as to be capable of performing the switching of a conveying route in the bookbinding apparatus B before the apparatus main body 2 conveys the sheet S into the bookbinding apparatus B.

The above-described bookbinding apparatus B is provided with at least a conveying and aligning portion 21 for conveying and aligning a single sheet S conveyed thereinto from the copying machine A, an adhesive applying portion 22 and a paper cutting portion 23, and is capable of selecting an adhesively securing and bookbinding mode and a paper cutting mode besides an ordinary discharging mode. The paper cutting in the paper cutting mode is possible in the other three directions than the adhesively secured surface of a sheet bundle S1 which will be described later.

The conveying and aligning portion 21 is provided with a first conveying path T1 for conveying the sheet conveyed thereinto from the copying machine A, and second and third conveying paths T2 and T3 bifurcating from the first conveying path T1. A pair of carrying-in rollers 25 are provided in the first conveying path T1, and downstream of this pair of carrying-in rollers 25, there is provided a switching flapper 27 for switching the conveying paths, in the branch-off portion of the second conveying path T2 and the third conveying path T3.

When in such a form of the conveying path, the ordinary discharging mode is selected on the apparatus main body 2 side, the sheet S conveyed into the bookbinding apparatus B from the apparatus main body 2 through the first conveying path T1 is guided to the third conveying path T3 by the switching flapper 27, and is discharged to the sheet discharge tray 35 of the post-treatment apparatus C through a plurality of pairs of conveying rollers 29 provided in this third conveying path T3 (as required, is subjected to a post-treatment such as stapling, and thereafter is discharged to the sheet discharge tray 35). On the other hand, when the bookbinding mode is selected on the apparatus main body 2 side, the sheet S is guided to the second conveying path T2 by the switching flapper 27 and also, is adhesively bound (bound by e.g. glue) via the adhesive applying portion 22 and the paper cutting portion 23, and thereafter is discharged to a containing portion 34.

Downstream of the second conveying path T2, there is disposed an accumulating portion 42 constituting the aligning area of the conveying and aligning portion 21 and accumulating the sheets S successively conveyed thereto. This accumulating portion 42 has a containing portion 42*a* for successively accumulating therein the sheets S actually conveyed thereto, and stacks thereon a predetermined number of sheets S in their inclined state by the containing portion 42*a* to thereby form a sheet bundle S1. In this case, the containing portion 42*a* is slidable in the stacking direction of the sheets S (the thickness direction of the sheet bundle S1) by a sliding mechanism, and in the present embodiment, is adapted to be fixed at an arbitrary slide position by a rack. Also, the accumulating portion 42 is provided an urging arm 52 for urging the sheet S against the containing portion 42*a*, and this urging arm 52 is supported for pivotal movement about a rotary shaft 52*a*.

Figure 2:
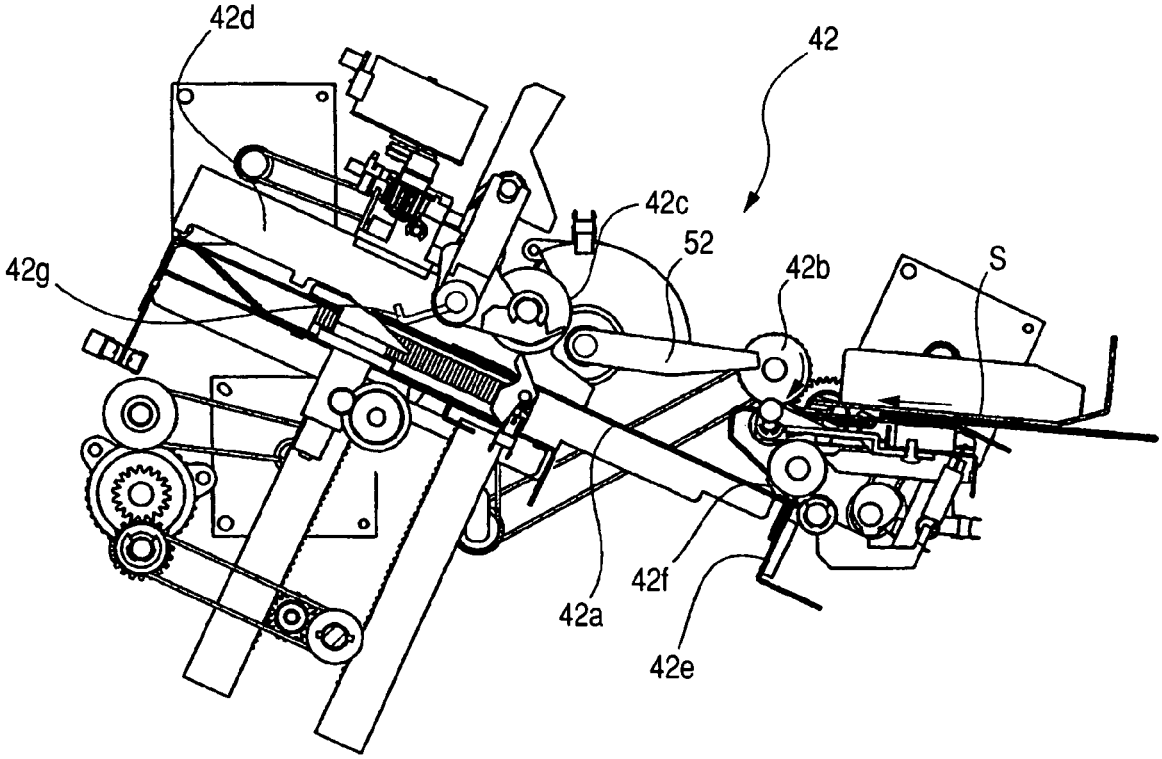
FIG. 2 shows the construction of an accumulating portion shown in FIG. 1.

The detailed construction and operation of the accumulating portion 42 will be described here with reference also to FIG. 2.

When the bookbinding mode is selected on the apparatus main body 2 side, the sheets S discharged from the apparatus main body 2 are guided from the first conveying path T1 to the second conveying path T2 through the pair of carrying-in rollers 25 and the switching flapper 27, and thereafter are directed to the accumulating portion 42. The sheets S directed to the accumulating portion 42 are successively stacked on the containing portion 42*a*. At this time, the sheet discharged from a sheet discharge roller 42*b* is conveyed to a predetermined position by a switchback roller 42*c*. When the sheet is thus conveyed, the switchback roller 42*c* is retracted from the sheet by a driving system (not shown), and the urging arm 52 is pivotally moved to thereby close an introduction space for the sheet. Next, with the switchback roller 42*c* retracted, a width direction aligning plate 42*d* carries out the aligning process in the width direction of the sheet.

If at this time, as is often the case with the conventional art, the width direction aligning plate 42*d* has its supporting portion below the containing portion 42*a*, the interval between the supporting portion and the sheet S becomes greater as the number of accumulated sheets is increased, and aligning accuracy is reduced due to the backlash of the supporting portion and the part accuracy and rigidity of the width direction aligning plate. So, in the present embodiment, there is adopted a construction in which the supporting portion overlies the containing portion 42*a* and the aligning plate is suspended from an upper surface. By adopting the structure in which the aligning plate is suspended from the upper surface, it becomes possible to narrow the interval between the portion supporting the width aligning plate 42*d* and the sheet S to be subjected to alignment in the width direction, and the width direction aligning plate 42*d* can be made small and also, even if the width direction aligning plate 42*d* is of low rigidity, the aligning process can be carried out with good accuracy.

When the alignment in the width direction is completed, the switchback roller 42*c* so far retracted contacts with the sheet again, and carries out the aligning process in the conveying direction. The aligning process in the conveying direction is carried out with the sheet being urged against a reference surface 42*e* by the switchback roller 42*c*. Design is made such that in this case, the switchback roller 42*c* and the sheet S slip with the sheet S being urged against the reference surface 42*e*, but if for example, the sheet is a thin sheet liable to be buckled, the sheet will be buckled by the coefficient of friction between the sheet S and the switchback roller 42*c*, depending on the curled state of the sheet, even if the urging force is slight, and therefore an appropriate urging force against the reference surface 42*e* is not obtained and faulty alignment will result. So, in the present embodiment, there is adopted a construction in which a buckling space for the sheet is eliminated by the urging arm 52 to thereby obtain an appropriate urging force without the sheet being buckled.

When the sheet is then urged against the reference surface 42*e* with an appropriate force, a sheet presser 42*f* is moved down and nips and fixes an end portion of the sheet S. This operation is repeated, whereby the sheets are successively stacked on the accumulating portion 42. When the sheets are stacked, the sheet containing portion is controlled on the basis of the signal of a sheet upper surface position detecting device 42*g* for detecting the height of the stack surface of the sheets so that the stack surface of the sheets may assume a constant height. Irrespective of the number of stacked sheets, the height of the stack surface of the sheets is controlled to a constant height, whereby when the sheet is discharged from the sheet discharge roller 42*b*, the sheet keeps an appropriate distance from the sheet discharge roller 42*b* and therefore, even in the case of thin sheets liable to be buckled or curled sheets, a stable stacking operation can be performed.

The above-described containing portion 42*a*, when a predetermined sheet bundle S1 is formed thereon, is downwardly moved to a first position P1 by a predetermined distance as indicated by the arrow "a" while keeping an obliquely oriented sheet receiving posture, and thereafter is moved in a direction (obliquely downwardly) orthogonal to that movement direction by a predetermined distance as indicated by the arrow "b", and is positioned at a second position P2. Such movement of the containing portion 42*a* is performed by a moving mechanism, not shown in detail.

Also, the conveying and aligning portion 21 is provided with a bundle conveying device for conveying the sheet bundle positioned at the second position P2 toward the adhesive applying portion 22, and a bundle position correcting device for correcting the adhesive applying position for the sheet bundle before the application of the adhesive. In this case, the bundle position correcting device shown by way of example in the present embodiment also has the function as a bundle conveying device for conveying the sheet bundle while nipping the sheet bundle, and is adapted to position-correct the sheet bundle, and thereafter deliver the sheet bundle to the adhesive applying portion 22. For example, specifically, the bundle position correcting device has a gripper mechanism (holding mechanism) having the function of nipping the sheet bundle.

The construction of the gripper mechanism will be described here with reference to FIGS. 1, 3 and 4.

Figure 3:
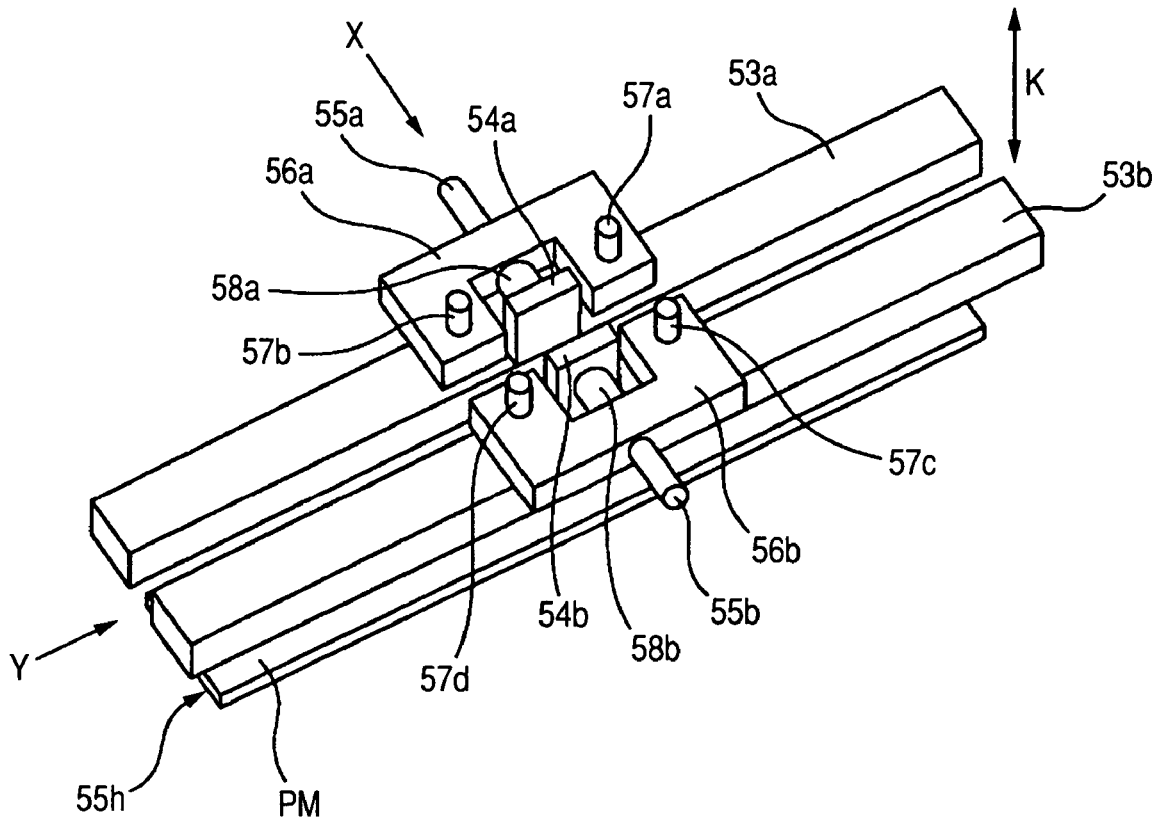
FIG. 3 is a perspective view of a gripper mechanism having a bundle position correcting function.

FIG. 3 is a perspective view of essential portions constituting the gripper mechanism. As shown in FIG. 3, the gripper mechanism is provided with a pair of grippers (first gripping members) 53*a* and 53*b* for nipping the front side and back side of the bundle sheet S1 from the opposite sides thereof over the full width thereof, and a pair of small grippers 54*a* and 54*b*. The pair of small grippers (second gripping members) 54*a* and 54*b* for nipping the sheet bundle S1 from the opposite sides thereof by the pressing surfaces of a small area thereof are provided on the central portions of the upper surfaces of the respective grippers 53*a* and 53*b*, and the respective small grippers 54*a* and 54*b* are fixed to the distal end portions of rotary shafts 55*a* and 55*b*, respectively, orthogonal to the longitudinal direction of the grippers 53*a* and 53*b*.

In this case, the rotary shafts 55*a* and 55*b* are journalled to holding plates 56*a* and 56*b*, respectively, provided on the respective grippers 53*a* and 53*b*, and these holding plates 56*a* and 56*b* contain the small grippers 54*a* and 54*b* in respective spaces open to the sheet bundle side so as to be opposed to each other. Also, the holding plates 56*a* and 56*b* are held by a pair of slide shafts 57*a* and 57*b* and a pair of slide shafts 57*c* and 57*d* provided upright on the upper surfaces of the grippers 53*a* and 53*b*, respectively, for movement in the direction indicated by the arrow K which is the height direction of the sheet bundle S1. Small gripper springs 58*a* and 58*b* as biasing members for biasing the small grippers 54*a* and 54*b*, respectively, toward a sheet pressing side are inserted between the back sides (sides opposite to the pressing surfaces) of the small grippers 54*a* and 54*b* and the opposed surfaces of the holding plates 56*a* and 56*b*.

These grippers 53*a* and 53*b* are designed to pivotally move the sheet bundle S1 held at the second position P2 by a pivotally moving mechanism (not shown) in a direction indicated by the arrow "c" in FIG. 1 to thereby turn it toward a substantially vertical direction (make it stand in the substantially vertical direction).

Figure 4:
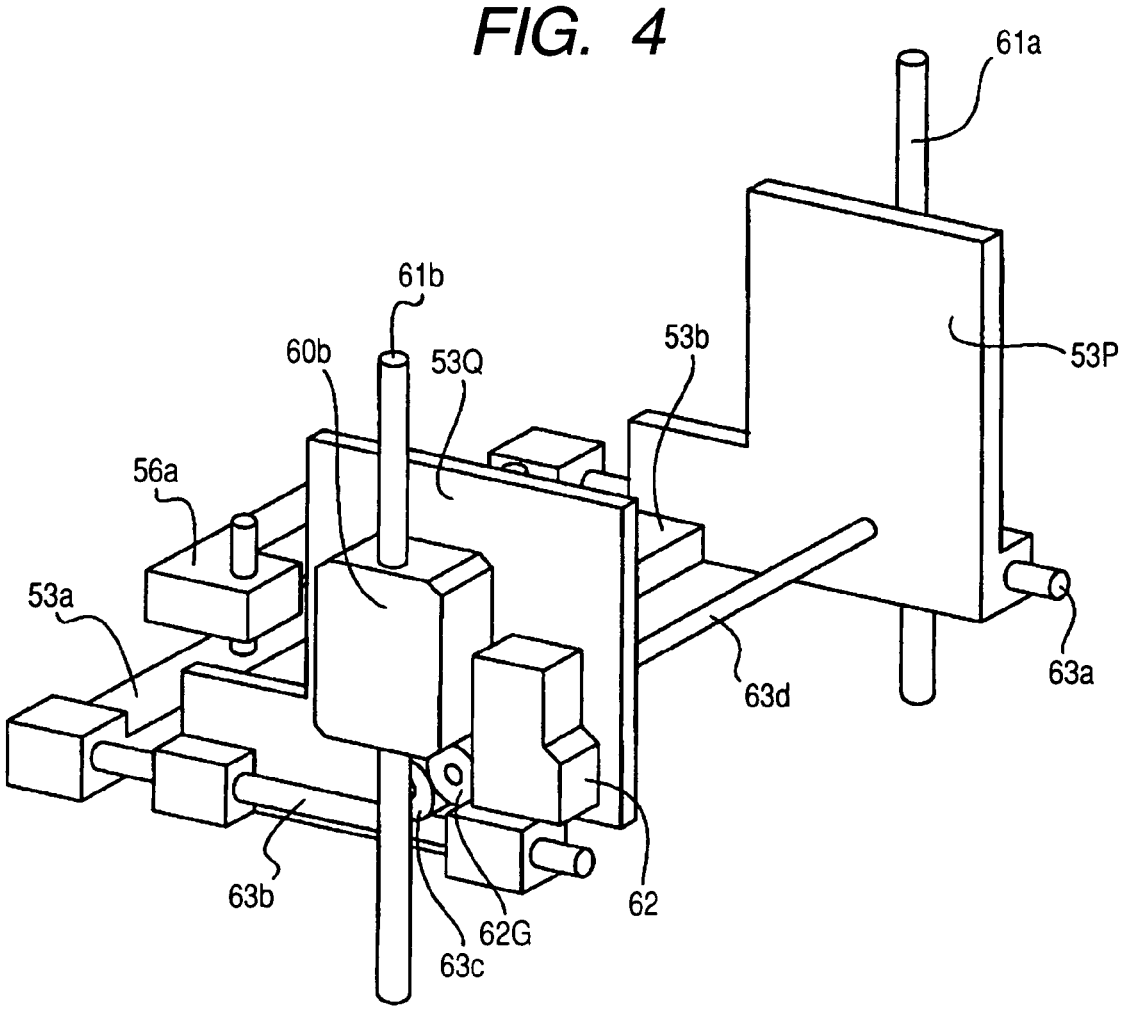
FIG. 4 is a schematic perspective view showing a gripper moving mechanism.

Also, as shown in FIG. 4, the gripper 53*b* is integrally mounted on a front side plate 53P and a rear side plate 53Q constituting a portion of a housing, on the opposite sides of the gripper 53*b*. The front side plate 53P and the rear side plate 53Q are adapted to be engaged with up and down guide shafts 61*a* and 61*b*, respectively, to thereby be driven up and down along the axial direction thereof. Specifically, the rear side plate 53Q has mounted thereon an up and down driving device (in the present embodiment, constituted by an up and down geared motor 60*b* rotatable in forward and reverse directions, and a gear (not shown) contained in this up and down geared motor 60*b* meshes with a rack (not shown) formed on the up and down guide shaft 61*b*, and the up and down geared motor 60*b* is forwardly reversely driven, whereby the front side plate 53P and the rear side plate 53Q are driven up and down along the up and down guide shafts 61*a* and 61*b*, respectively. That is, the gripper 53*b* (the entire housing including the up and down geared motor 60*b* together with the gripper 53*a*) is adapted to perform an upward and downward moving operation along the up and down guide shafts 61*a* and 61*b* by the driving of the up and down geared motor 60*b*, and be moved between a holding position for holding the sheet bundle S1 at the second position P2 and a delivering position for delivering the sheet bundle S1 to the paper cutting apparatus 23, and has the conveying function of conveying the sheet bundle S1.

Also, opening and closing guide shafts 63*a* and 63*b* partly formed with racks (not shown) are inserted in the opposite ends (the front portion and rear portion) of the gripper 53*a*, and the gripper 53*a* is held for movement along the axial direction thereof (the nipping direction of the sheet bundle S1). Specifically, the rear side plate 53Q constituting a portion of the housing has mounted thereon an opening and closing drive device (in the present embodiment, a forwardly and reversely rotatable opening and closing motor 62 and an idle gear 62G meshing with the output portion of the opening and closing motor 62), and this idle gear 62G is in meshing engagement with a gear 63*c* meshing with the rack formed on the opening and closing guide shaft 63*b*. In this case, the gear 63*c* is mounted on one end portion of a driving shaft 63*d* rotatably held between the front side plate 53P and the rear side plate 53Q, and a gear meshing with the rack formed on the opening and closing guide shaft 63*a* is mounted on the other end portion of the driving shaft 63*d*. That is, the opening and closing motor 62 is forwardly/reversely driven, whereby the driving shaft 63*d* is rotatively driven through the idle gear 62G, and along therewith, the opening and closing guide shafts 63*a* and 63*b* are moved along the axial direction thereof through the racks formed thereon. As the result, the gripper 53*a* is adapted to be movable to open and close between a closed position for nipping the sheet bundle S1 from the opposite sides thereof and an opened position for releasing the nipping of the sheet bundle S1 (this opened position includes a first opened position in which the small grippers 54*a* and 54*b* nip the sheet bundle S1 from the opposite sides thereof, and a second opened position in which the small grippers 54*a* and 54*b* release the nipped state of the sheet bundle S1).

Also, in connection with the above-described gripper mechanism, there is provided a bundle position reference surface PM for ramming the lower end surface of the sheet bundle S1 against the bundle position reference surface PM. This bundle position reference surface PM has the function of correcting the inclination of the sheet bundle S1 with respect to the adhesive applying position for the bundle sheet S1. That is, the sheet bundle S1 is rammed against the bundle position reference surface PM, whereby the sheet bundle S1 is made parallel to the bundle position reference surface PM (the bundle position correction of making the edge portion on the adhesive applying side which is the lower end of the sheet bundle S1 and the bundle position reference surface PM parallel to each other is performed), whereafter the sheet bundle S1 is nipped by the grippers 53*a* and 53*b* and is conveyed to the adhesive applying position by the adhesive applying portion 22, and an adhesive is adapted to be uniformly applied to the end edge of the sheet bundle S1. At this time, the relative positional relation between the bundle position reference surface PM and the adhesive applying position by the adhesive applying portion 22 is kept by the grippers 53*a* and 53*b*.

The installation place for the above-described bundle position reference surface PM can be near the adhesively securing position by the adhesive applying portion 22, and if on a route for nipping and conveying the sheet bundle S1 to the adhesively securing position, may be at another place. In the present embodiment, the bundle position reference surface PM is provided at a place which is near the adhesively securing position at which the sheet bundle S1 assumes a vertical state and which does not interfere with an adhesive applying unit 66 which will be described later. Also, it is possible to form the above-described bundle position reference surface PM, for example, by the surface of a flat plate-shaped member (bundle position reference member) 55*h*installed at a predetermined location in the bookbinding apparatus B. In this case, if the flat plate-shaped member (bundle position reference member) 55*h*constituting the bundle position reference surface PM is made detachably insertable into the adhesively securing position, it is also possible to perform bundle position correction at the adhesively securing position.

The adhesive applying portion 22 is provided between a cover adhesively securing portion 60 provided downstream of the third conveying path T3 which will be described later and the second position P2.

The adhesive applying portion 22 is provided with the adhesive applying unit 66 for holding the adhesive (e.g. hot-melt adhesive) and applying the held adhesive to an end edge of the sheet bundle S1, and a moving mechanism (not shown) for moving this adhesive applying unit 66 along the end edge of the sheet bundle S1. The adhesive applying unit 66 is provided with a container (adhesive container) 66*a* made of e.g. aluminum containing the adhesive therein and upwardly opening, an applying roller 66*b* as a rotary member rotatably supported by the container 66*a*, and a heating portion for applying heat to the adhesive. In this case, the applying roller 66*b* is formed of e.g. heat-resisting rubber, and contacts with the adhesive molten in the container 66*a* and holds it by the surface thereof and also, applies the adhesive held on the surface thereof to the end edge of the sheet bundle S1 while rotating by itself.

Also, such an adhesive applying unit 66 is movable among an applying area for applying the adhesive to the sheet bundle S1 (an area in FIG. 1 wherein the container 66*a* is located), a standby position retracted from the conveying route (substantially vertical conveying route) of the sheet bundle S1 to be ready for the applying process, and a supplying position for receiving the supply of the adhesive (the adhesive is supplied through the opening of the container 66*a*), i.e., a position opposed to an adhesive supplying apparatus 90.

Below the adhesive applying unit 66, there is provided a cover adhesively securing portion 60 for executing the casing-in of a book which cases the formed sheet bundle S1 in a cover, and under this cover adhesively securing portion 60, there is installed a slidable ramming plate 59. The sheet bundle S1 to which the end edge of which the cover has been attached by the cover adhesively securing portion 60 is adapted be urged against this ramming plate 59 while being nipped by the grippers 53*a* and 53*b*. Design is made such that by the sheet bundle being urged against the ramming plate 59, the cover becomes adhesively secured to the end edge of the sheet bundle, and the sheet bundle S1 is intactly delivered to the paper cutting portion 23 while being nipped by the grippers 53*a* and 53*b*.

Figure 5:
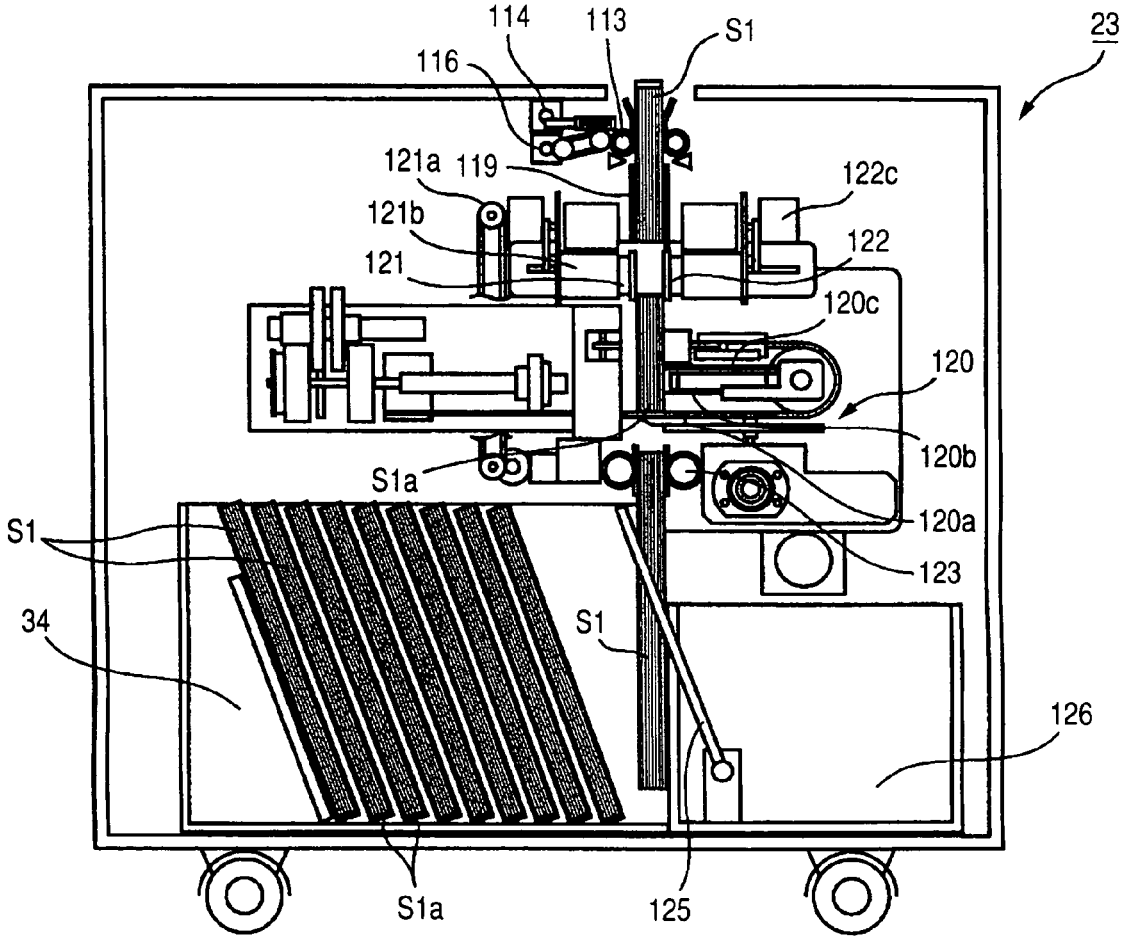
FIG. 5 is a side view showing the general construction of a paper cutting portion.
Figure 6:
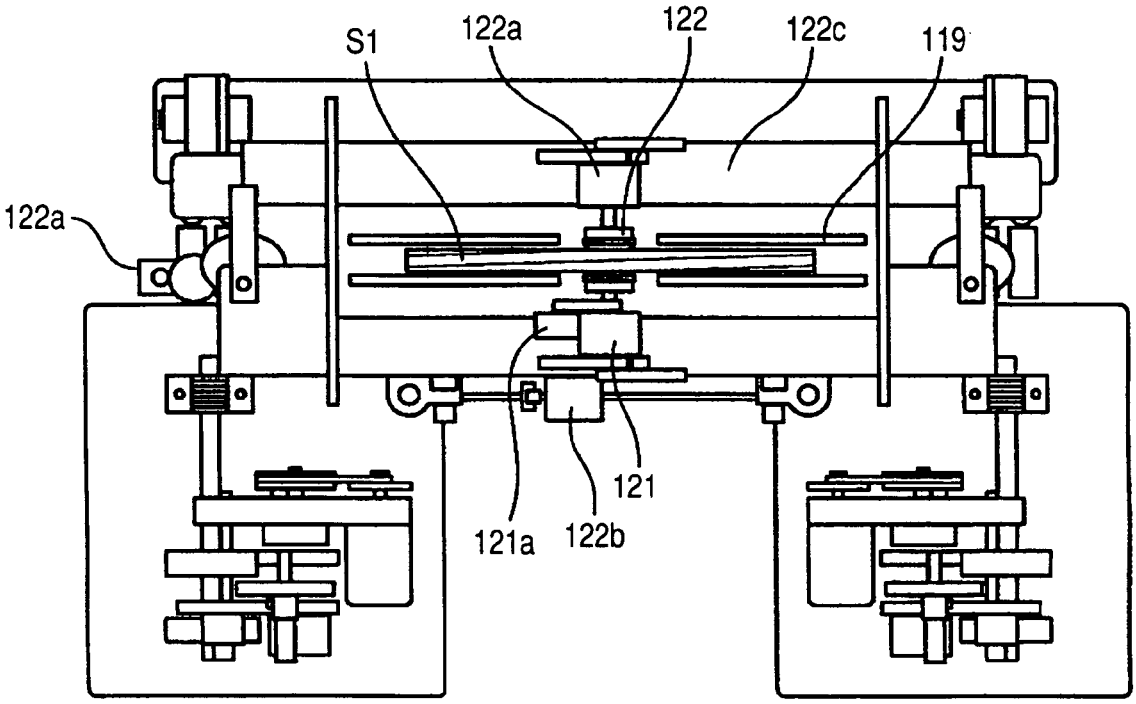
FIG. 6 is a plan view showing the construction of the paper cutting portion.

FIGS. 5 and 6 show the detailed construction of the paper cutting portion 23 shown in FIG. 1, FIG. 5 being a side view showing the general construction of the paper cutting portion 23, and FIG. 6 being a plan view.

In this paper cutting portion 23, the sheet bundle S1 nipped by the grippers 53*a* and 53*b* is conveyed to a paper cutting unit 120 through entrance conveying rollers 113. The paper cutting unit 120 is provided with a rotary table 121 on which the sheet bundle S1 is placed, a rotatable gripper 122 for nipping and fixing the sheet bundle S1 on the rotary table 121, a gripper driving mechanism 122*a* for pressing the gripper 122 against the rotary table 121, a gripper moving mechanism 122*b* for freely moving the gripper 122 toward the paper cutting unit 120, and a gripper frame 122*c* for holding the gripper 122. Also, the paper cutting unit 120 is provided with a paper cutting blade 120*a*, a movable pressing plate 120*b* for pressing an end portion of the sheet bundle S1 during paper cutting, a fixing and pressing plate 120*c*, and a pressing plate moving mechanism for driving these.

Description will now be made specifically of the operation of the bookbinding apparatus B constructed as described above.

As described above, the sheets S are successively conveyed from the copying machine A to the accumulating portion 42, and a predetermined number of sheets S are accumulated (a sheet bundle S1 of a predetermined thickness is formed), whereupon the containing portion 42*a* is moved to the second position P2 by a moving mechanism, not shown in detail, through the first position P1. Then, at this second position P2, the sheet bundle S1 on the containing portion 42*a* is held by the grippers 53*a* and 53*b* which has so far stood by at the above-described second opened position (the grippers 53*a*, 53*b* and the small grippers 54*a*, 54*b* are all opened). At this time, the grippers 53*a* and 53*b* grip the sheet bundle S1 at such a degree of position that the end portion of the sheet bundle S1 on the adhesive applied side protrudes downwardly from the grippers. The sheet bundle S1 is gripped by the grippers 53*a* and 53*b*, and thereafter is pivotably moved and turned to a vertical direction, and is conveyed toward the adhesive applying portion 22 while keeping its vertical state.

The grippers 53*a* and 53*b* are provided with a thickness detecting device for detecting the thickness of the sheet bundle S1 so as to be capable of detecting the thickness at a point of time whereat they have held the sheet bundle S1. In this case, the thickness detecting device can detect the thickness by using, for example, slide resistance, but it is possible to use one of various methods if the detecting device is means, which can proportionally detect the thickness of the sheet bundle.

The grippers 53*a*and 53*b* have the function of pivotally moving the held sheet bundle S1 in the direction indicated by the arrow "c" in FIG. 1 to thereby turn it to a substantially vertical direction (make it stand in the substantially vertical direction) and also, conveying the sheet bundle S1 downwardly toward the adhesive applying portion 22 while maintaining the substantially vertical state (with an end edge (the end edge to which the adhesive which will be described later is applied) of the sheet bundle S1 facing down). In addition to such a conveying function for the sheet bundle S1, the grippers 53*a*and 53*b* have a bundle position correcting function for the sheet bundle S1 performed before the adhesive is applied.

Reference is had here to FIGS. 7A to 11B to describe the bundle position correcting step for the sheet bundle S1 carried out before the adhesive is applied to the end edge of the sheet bundle S1 conveyed by the grippers 53*a* and 53*b*, by the adhesive applying portion 22.

FIGS. 7A, 7B, 8A, 8B, 9A, 9B, 10A, 10B, 11A and 11B show the bundle position correction in the order of steps. Of these figures, FIGS. 7A, 8A, 9A, 10A and 11A show a state as viewed along the direction indicated by the arrow X shown in FIG. 3, and FIGS. 7B, 8B, 9B, 10B and 11B show a state as viewed along the direction indicated by the arrow Y shown in FIG. 3.

Figure 7B:
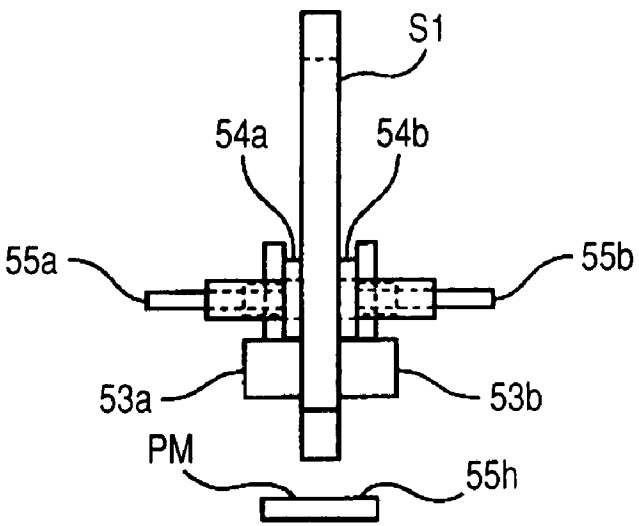
FIG. 7B is a side view corresponding to FIG. 7A.
Figure 7A:
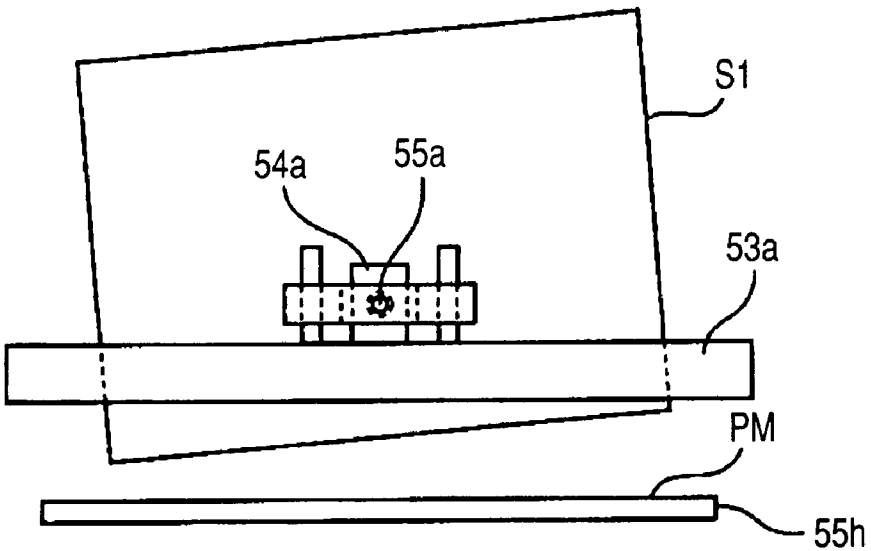
FIG. 7A is a front view showing a state in which a sheet bundle has been conveyed to a position opposed to a bundle position reference surface.

FIGS. 7A and 7B show a state in which the sheet bundle S1 has come to the installed position of the bundle position reference surface PM which is the vicinity of the adhesive applying portion 22 at which the sheet bundle S1 assumes a vertical state and does not interfere with the adhesive applying unit 66. At the second position P2, the grippers 53*a* and 53*b* are in the second opened position wherein the small grippers 54*a* and 54*b* are opened, at first, but assume a closed position when the sheet bundle S1 is conveyed to the second position P2, and nip the sheet bundle S1 therebetween. At this time, as shown in FIG. 7A, the sheet bundle S1 may be nipped with its end edge inclined relative to the grippers 53*a* and 53*b*. Such inclination of the sheet bundle S1 occurs when at the second position P2, the grippers 53*a* and 53*b* nip the sheet bundle S1 therebetween.

Figure 8B:
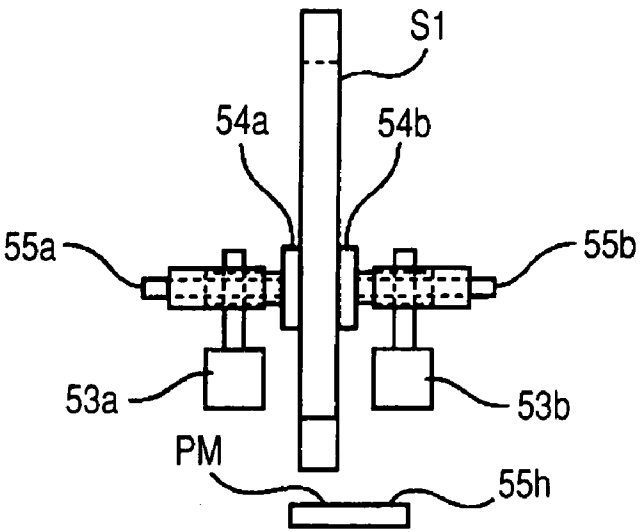
FIG. 8B is a side view corresponding to FIG. 8A.
Figure 8A:
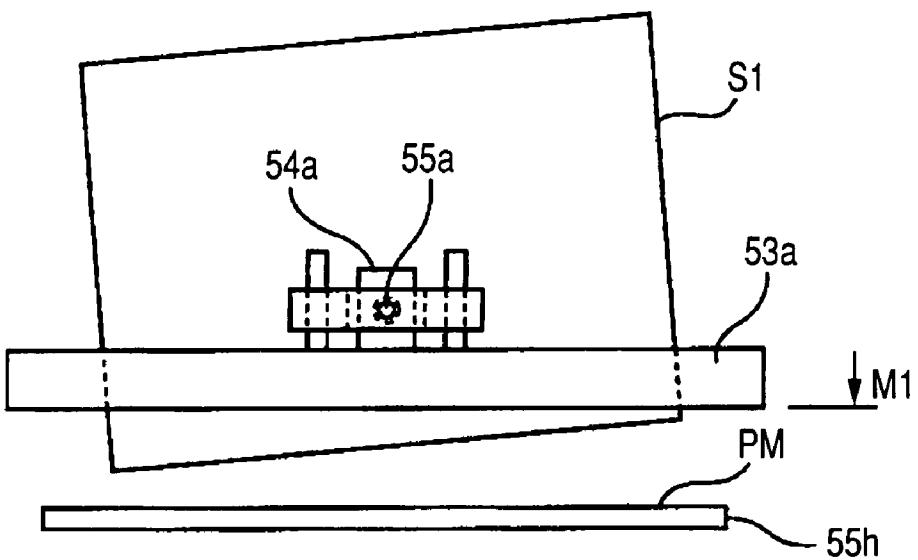
FIG. 8A is a front view showing a state in which the sheet bundle has been moved from the position opposed to the bundle position reference surface to a correction starting position.

Next, the grippers 53*a* and 53*b* are pivotally moved and as shown in FIGS. 8A and 8B, the grippers 53*a* and 53*b* arrive at a correction starting position M1 for the sheet bundle S1, whereupon the gripper 53*a* is driven to the first opened position by the driving of the opening and closing motor 62 (see FIG. 4). At this time, as shown in FIG. 8B, in the first opened position, the gripper 53*a* is opened to the left relative to the gripper 53*b* and liberates the sheet bundle S1, but at that time, the small grippers 54*a* and 54*b* nipping the center of the lower portion of the sheet bundle S1 therebetween are also intactly moved to the left and therefore remain closed. In this state, the sheet bundle S1 is nipped between the small grippers 54*a* and 54*b* by the biasing forces of small gripper springs 58*a* and 58*b*.

Figure 9B:
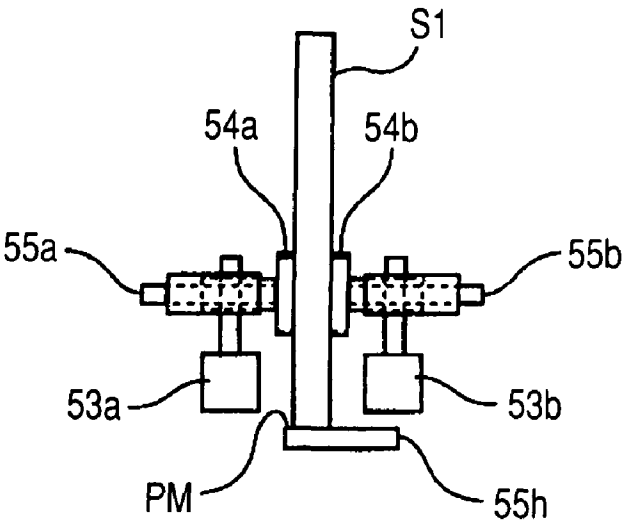
FIG. 9B is a side view corresponding to FIG. 9A.
Figure 9A:
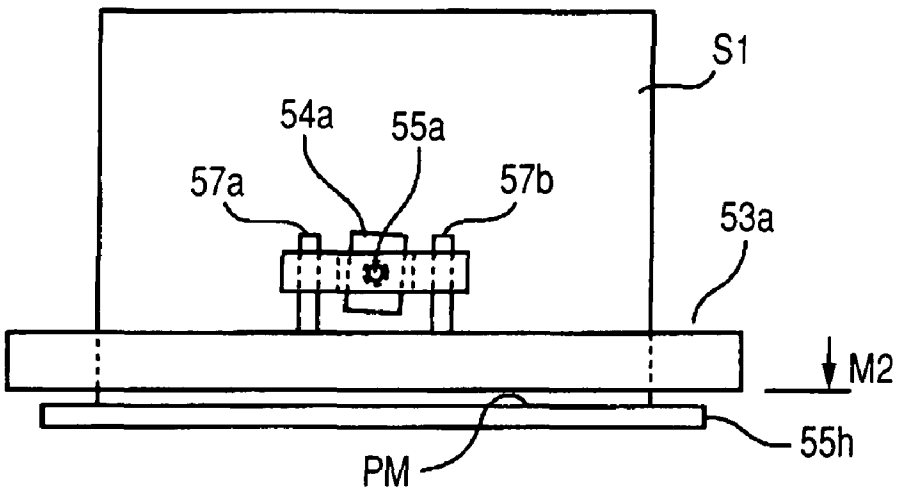
FIG. 9A is a front view showing a state in which the sheet bundle has been pushed against the bundle position reference surface.

Next, the grippers 53*a* and 53*b* are further moved to a correcting position M2 by the driving of the up and down geared motor 60*b* (see FIG. 4). As shown in FIGS. 9A and 9B, the sheet bundle S1 is rammed against the bundle position reference surface PM of the plate member (bundle position reference member) 55*h* while remaining nipped by the small grippers 54*a* and 54*b*, and by the force of the rammed sheet bundle S1, the sheet bundle S1 is rotated about the rotary shafts 55*a* and 55*b* in a direction in which the inclination of the sheet bundle S1 is corrected. At this time, the small grippers 54*a* and 54*b* slide upwardly relative to slide shafts 57*a*, 57*b* and slide shafts 57*c*, 57*d* integrally with holding plates 56*a* and 56*b* with the sheet bundle S1 as support. As the result, the sheet bundle S1 is pushed against the bundle position reference surface PM by the gravity of the sheet bundle and the gravity of the small grippers 54*a* and 54*b* and thus, the parallelism thereof to the bundle position reference surface PM is secured.

Figure 10B:
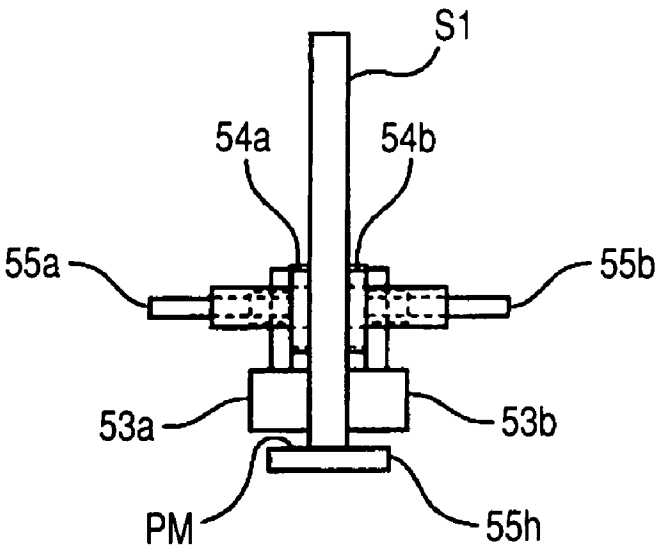
FIG. 10B is a side view corresponding to FIG. 10A.
Figure 10A:
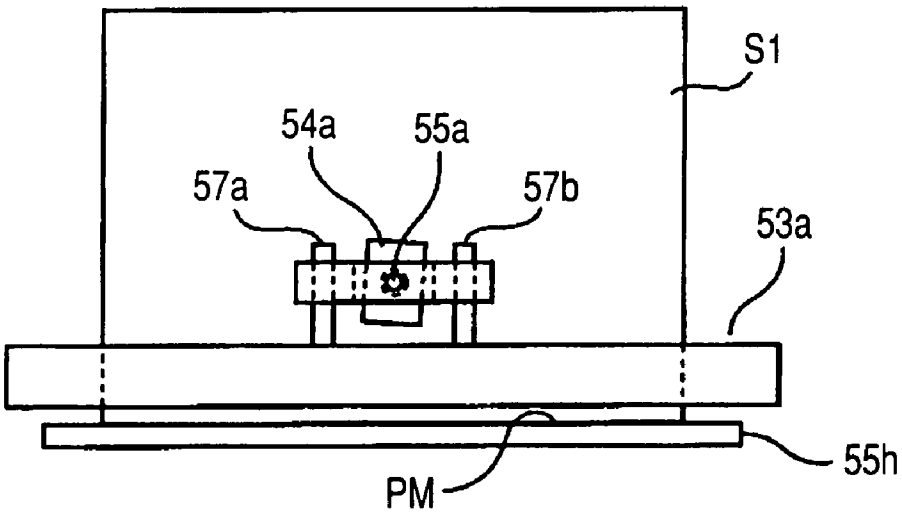
FIG. 10A is a front view showing a state in which the sheet bundle having had its inclination corrected has been nipped by a gripper.

Then, in this state, as shown in FIGS. 10A and 10B, the gripper 53*a* is controlled so as to assume a closed position in which the sheet bundle S1 is nipped. That is, the nipping by the grippers 53*a* and 53*b* is resumed with the inclination of the sheet bundle S1 having been completely corrected.

As described above, before the application of the adhesive, bundle position correction is performed by the bundle position correcting device to thereby secure the parallelism between the sheet bundle and the bundle position reference surface PM, whereby the parallelism is secured without the sheet bundle S1 being subjected to the milling process, and the uniform application of the adhesive is realized. That is, the milling process becomes unnecessary and therefore, it is unnecessary to install the rubbish treating apparatus for sucking and treating the rubbish produced by the ordinary milling process or the rubbish collecting container for collecting the rubbish therein.

Figure 11B:
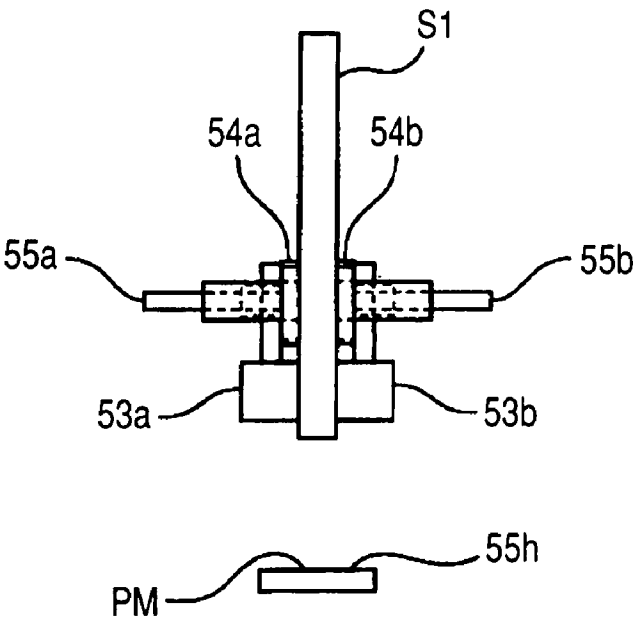
FIG. 11B is a side view corresponding to FIG. 11A.
Figure 11A:
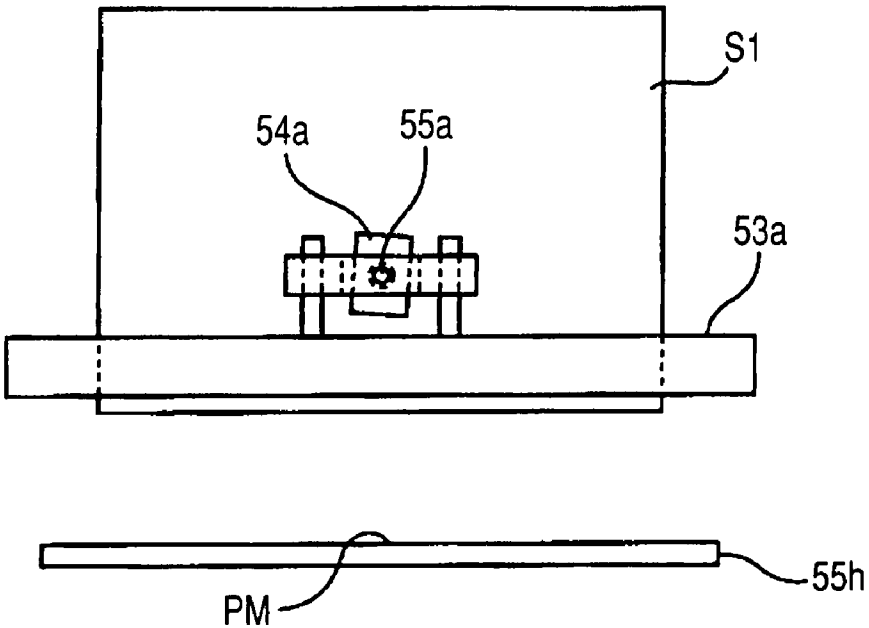
FIG. 11A is a front view showing a state in which the sheet bundle having had its inclination corrected has been nipped and spaced apart from the bundle position reference surface by the gripper.

Next, as shown in FIGS. 11A and 11B, the grippers 53*a* and 53*b* are elevated and also, the sheet bundle S1 is moved to a predetermined position on the applying area of the adhesive applying unit 66 in the movement route thereof to thereby position the sheet bundle S1 in a substantially vertical state. In a case where the bundle position reference surface PM is provided on an adhesively securing position, the plate member (bundle position reference member) 55*h* can be retracted.

When in this manner, the sheet bundle S1 is positioned at a predetermined position on the applying area, the adhesive applying unit 66 having so far stood by at the standby position is moved to a predetermined starting position in the applying area. Thereafter, the adhesive applying unit 66 is moved relative to the sheet bundle S1 from the starting position toward a predetermined turn-back position with the forwardly rotated applying roller 66*b* being in contact with the end edge of the sheet bundle S1. Thereby, the adhesive is uniformly applied to the end edge of the sheet bundle S1 by the applying roller 66*b* bearing on its surface the molten adhesive in the container 66*a*.

When the adhesive applying unit 66 then arrives at the turn-back position, the forward rotation of the applying roller 66*b* is stopped, and the movement of the adhesive applying unit 66 is also stopped. At this point of time, now with the applying roller 66*b* being reversely rotated, the adhesive applying unit 66 starts to be moved from the turn-back position toward the starting position, and at a stage whereat the adhesive applying unit 66 has again arrived at the starting position, the reverse rotation of the applying roller 66*b* is stopped, and the movement of the adhesive applying unit 66 is also stopped. The reciprocal movement as described above is effected e.g. twice, whereafter the adhesive applying work is completed.

In the construction as described above, it is preferable to adjust the interval between the end edge of the sheet bundle S1 and the applying roller 66*b* in accordance with the thickness of the sheet bundle S1. That is, when the thickness of the sheet bundle S1 is great, unless the thickness of the adhesive is made great, the strength of the back of the book is weak and the back may split when the book is opened, and when conversely, the thickness of the sheet bundle S1 is small, if the thickness of the adhesive is made great, the opening of the book will become bad. Therefore, irrespective of the kind of the sheet bundle S1, it is preferable to design the interval between the sheet bundle S1 and the applying roller 66*b* so as to be adjustable so that a proper thickness of the adhesive can be kept.

Also, in the above-described construction, it is preferable to position a cover to be adhesively secured at a predetermined position before the step of applying the adhesive. That is, if the application of the adhesive is performed before the cover is positioned, for example, the cover will be jammed in the conveying path and will not be positioned within a predetermined time, and in such a case, there is the possibility that the applied adhesive may be dried up and the sheet bundle in bookbinding may become useless. Therefore, as described above, the control of each constituent member is performed so that the application of the adhesive may be performed after the positioning of the cover has been completed.

Further, in preparation for the application of the adhesive, the adhesive in its molten state is contained in the container 66*a*, but if the adhesive is left unused in its molten state for a long time, the evaporation of the volatile component of the adhesive or the discoloration of the adhesive and a reduction in the physical properties thereof will result and therefore, when the positioning of the cover has not been completed within a predetermined time, it is preferable to control a heating portion for melting the adhesive to thereby stop heating.

When the application of the adhesive to the end edge of the sheet bundle S1 is completed, the adhesive applying unit 66 is moved to the standby position or the supplying position, and the conveying route for the sheet bundle S1 is secured. Thereafter, through this substantially vertical conveying route (a direction crossing the movement direction of the adhesive applying unit 66), the sheet bundle S1 nipped by the grippers 53*a* and 53*b* is moved down to the cover adhesively securing portion 60.

In this case, it is preferable to provide a temperature detecting device in the interior of the apparatus, and control the timing of the adhesive securing of the cover from the start of the downward movement on the basis of the temperature of the interior of the apparatus. This is because if the temperature of the interior of the apparatus exceeds a proper temperature, the protrusion of the adhesive will often occur during the adhesive securing and the quality of bookbinding may be reduced, and if conversely, the temperature of the interior of the apparatus becomes lower than the proper temperature, the adhesively securing force will become insufficient and the peeling-off of the cover may occur. Specifically, the timing of the adhesive securing of the cover from the start of the downward movement can be controlled on the basis of a preobtained proper adhesively securing temperature graph of the interior of the apparatus.

As described above, in the present embodiment, the cover has already been conveyed to and stands by in the cover adhesively securing portion 60 before the adhesive is applied to the end edge of the sheet bundle S1. In this case, the cover is paid away from a cover containing portion (not shown) containing covers therein, by a cover supplying device, and is conveyed to the cover adhesively securing portion 60, or is prepared on the apparatus main body 2 side of the copying machine A and thereafter is conveyed from the apparatus main body 2 to the cover adhesively securing portion 60. In a construction wherein the cover is conveyed from the apparatus main body 2 side to the cover adhesively securing portion 60, the cover is conveyed from the above-described first conveying path T1 to the third conveying path T3 through the switching flapper 27, and is positioned at a predetermined position in the cover adhesively securing portion 60 crossing the substantially vertical conveying route.

Then, the edge end of the sheet bundle S1 to which the adhesive has been applied is urged against the cover positioned as described above, from above in a vertical direction by the grippers 53*a* and 53*b*. Also, in this state, the sheet bundle S1 is further moved vertically downwardly by the grippers 53*a* and 53*b* with the cover remaining attached to the end edge thereof by the adhesive, and is urged against the slidable ramming plate 59 located under the cover adhesively securing portion 60. Thereafter, the cover and the sheet bundle S1 as they are rammed against the ramming plate 59 are pressed from opposite sides by a slidable back bending plate, whereby the cover is formed with a fold conforming to the thickness of the sheet bundle S1, and the bookbinding step is completed.

Next, the ramming plate 59 is outwardly slidden and a conveying route for the sheet bundle S1 is formed, whereafter the grippers 53*a* and 53*b* deliver the sheet bundle S1 having the cover adhesively secured thereto to the paper cutting portion 23 below while nipping the sheet bundle S1 therebetween.

When as shown in FIGS. 5 and 6, the sheet bundle S1 having the cover adhesively secured thereto is delivered to the paper cutting portion 23 by the grippers 53*a* and 53*b*, a conveying and moving mechanism 116 is started and the entrance conveying rollers 113 are rotated, whereby the sheet bundle S1 is vertically conveyed toward the paper cutting blade 120*a*. In this case, the entrance conveying rollers 113 are driven by a roller opening-closing moving mechanism 114 to thereby nip the sheet bundle S1 therebetween.

Next, the sheet bundle S1 discharged from the entrance conveying rollers 113 falls onto the paper cutting blade 120*a* with the aid of gravity, and is supported by a guide plate 119 forming a substantially vertical conveying route and at the same time, is pushed against and positioned on the paper cutting blade 120*a* while keeping a substantially vertical state.

When the sheet bundle S1 is positioned in this manner, the gripper 122 is driven by the gripper moving mechanism 122*a*, and the sheet bundle S1 is nipped and fixed between the gripper 122 and the rotary table 121.

Figure 12A:
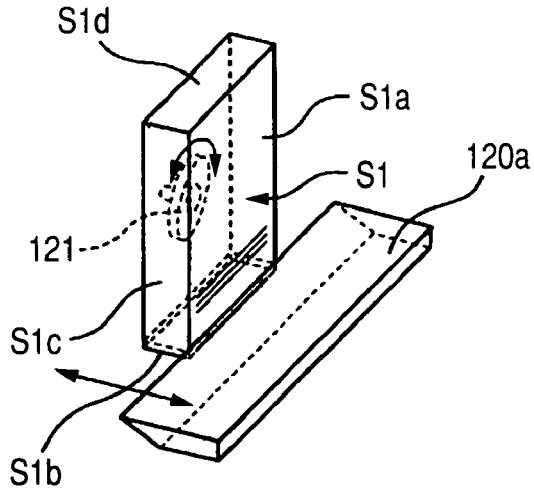
FIGS. 12A, 12B and 12C are perspective views stepwisely showing the paper cutting procedure by a paper cutting blade.

Next, the paper cutting blade 120*a* is moved to and stands by at a predetermined position to form a gap necessary for the rotation and movement of the sheet bundle S1, on the basis of the thickness information of the sheet bundle S1. Then, the rotary table 121 and the gripper 122 are driven through the gripper moving mechanism 122*a* and a rotating mechanism 121*a*, whereby the sheet bundle S1 nipped by the rotary table 121 and the gripper 122 is rotated (by 90°) and moved from a state in which the back S1*a* thereof as the end edge having the cover adhesively secured thereto faces down to a position as shown in FIG. 12A wherein the top portion S1*b* which is the other end edge can be cut by the paper cutting blade 120*a*. At this time, it is preferable that a lift mechanism 121*b* be driven to thereby rotate the sheet bundle S1 in a floated state from the guide plate 119 so that the cover surface of the sheet bundle S1 may not be injured by the rotation, and at a point of time whereat the rotation has been completed, the sheet bundle S1 be again brought into contact with the guide plate 119 by the lift mechanism 121*b*.

Figure 13A:
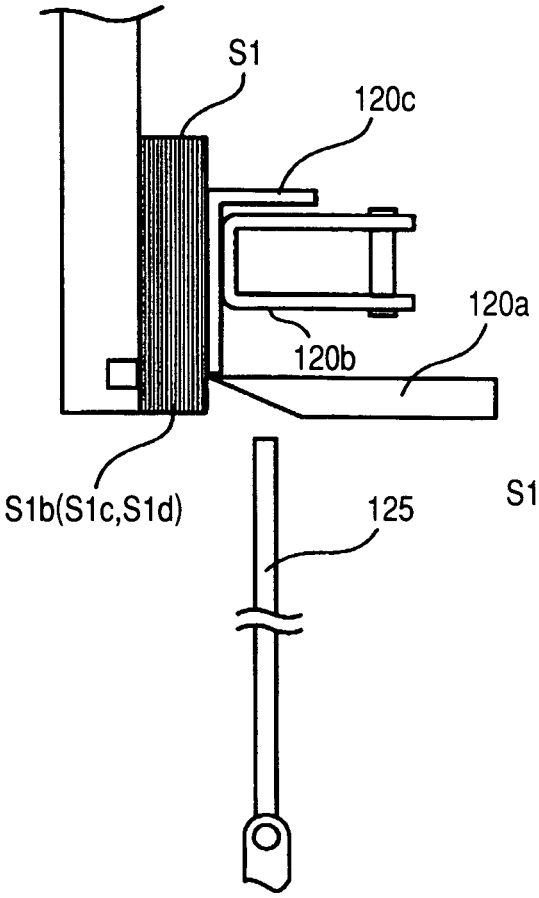
FIG. 13A shows the states of a paper cutting portion and a flapper before paper cutting.
Figure 13B:
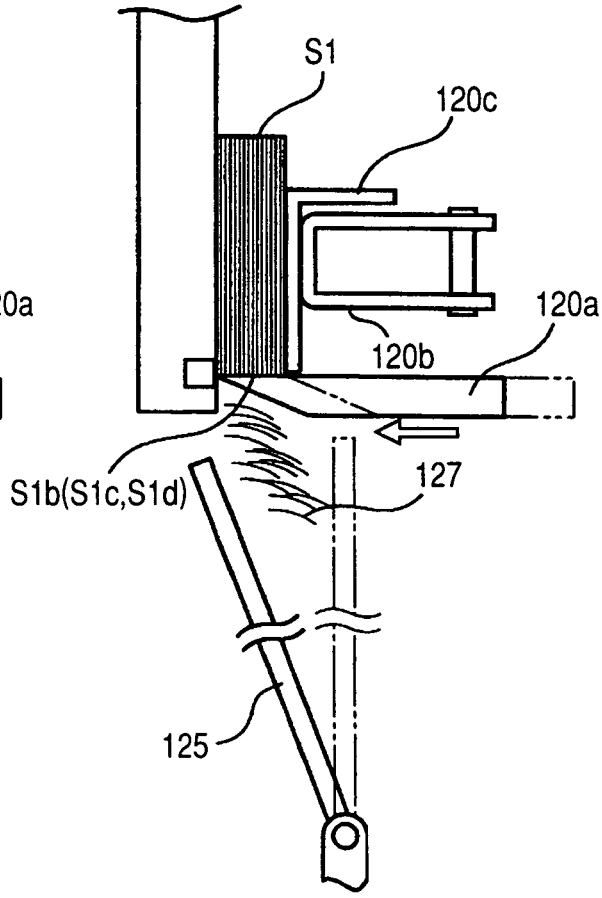
FIG. 13B shows the states of the paper cutting portion and the flapper during the paper cutting.

In the manner described above, the sheet bundle nipped by the rotary table 121 and the gripper 122 is fixed at a paper cutting position on the top portion S1*b*, whereupon the paper cutting unit 120 is driven by a control device (not shown) to thereby perform the cutting of the top portion S1*b*. Specifically, the pressing plate moving mechanism is driven by the control device, whereby the movable pressing plate 120*b* is moved and the top portion S1*b* side of the sheet bundle S1 is pressed by the movable pressing plate 120*b* and a fixed pressing plate 120*c* (see FIG. 13A). Then, the paper cutting blade 120*a* is moved in a horizontal plane so as to depict an arc, whereby the end edge of the top portion S1*b* is uniformly cut (see FIG. 13B). Also, at this time, rubbish 127 cut off falls with the aid of gravity, and is contained in a rubbish box 126 by a flapper 125. Specifically, when the paper cutting is started, the flapper 125 is pivotally moved to a rubbish receiving position indicated by a solid line in FIG. 13B by a control device (not shown), and the cut-off rubbish 127 falling with the aid of gravity with the paper cutting is contained in the rubbish box 126 by the guide of the flapper 125. Such efficient collection of the cut-off rubbish is realized by the sheet bundle S1 being conveyed by the vertical conveying route and cut, as described above. The flapper 125 is returned to its original position (a position indicated by the solid line in FIG. 13A ; a position indicated by the broken line in FIG. 13B) each time the cutting of a sheet bundle S1 is completed.

Figure 12B:
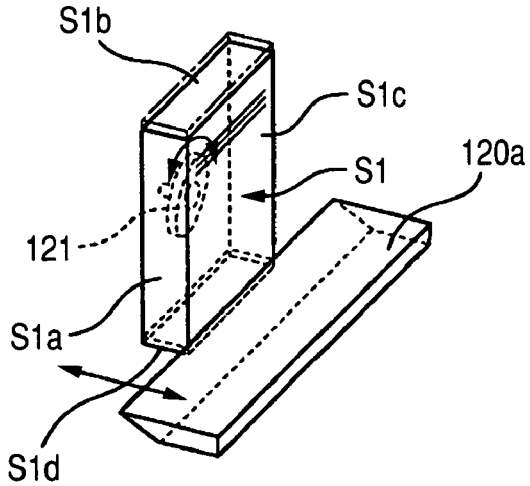
Figure 12C:
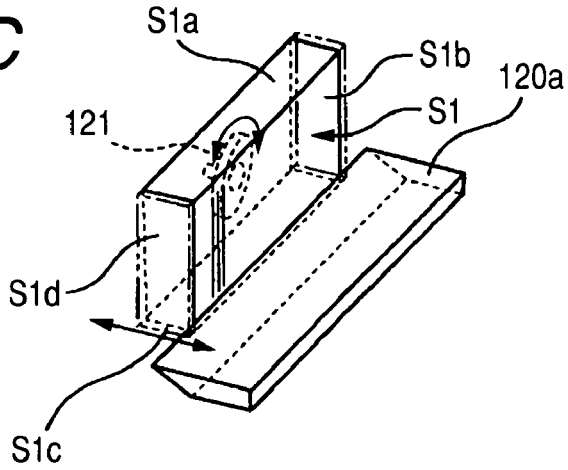

When the end edge of the top portion S1*b* has been cut in the manner described above, the movable pressing plate 120*b* and the paper cutting blade 120*a* are again moved to and stand by at the predetermined position to form a gap necessary for the rotation and movement of the sheet bundle S1, on the basis of the thickness information of the sheet bundle S1. Then, the rotary table 121 and the gripper 122 are again driven through the gripper moving mechanism 122*b* and the rotating mechanism 121*a* (by 180°) and moved from the state in which the top portion S1*b* faces down to a position as shown in FIG. 12B wherein a ground portion S1*d* which is another end edge can be further cut by the paper cutting blade 120*a*. When the sheet bundle S1 is then fixed at a cutting position for the ground portion S1*d*, the paper cutting unit 120 performs the cutting of the ground portion S1*d* by the control device (not shown). Thereafter, the sheet bundle S1 is further rotated by 90° in the same manner, whereby the cutting of an edge portion S1*c* which is the remaining end edge is performed (see FIG. 12C).

When the cutting of the three end edges is completed in the manner described above, the rotating mechanism 121*a* is driven, whereby the rotary table 121 is returned to its original position, and the gripper moving mechanism 122*b* is driven, whereby the sheet bundle S1 nipped by the gripper 122 and the rotary table 121 is conveyed to the containing portion 34 through the discharge rollers 123. In this case, the sheet bundle S1 discharged by the discharge rollers 123 is pushed into the containing portion 34 by the flapper 125 and also, is accumulated and contained in the containing portion in a substantially vertically upright state in which its back S1*a* as the end edge having the adhesive applied thereto faces down.

As described above, according to the present embodiment, irrespective of the state and number of the sheets, the aligning process of good accuracy becomes possible by the bundle position correcting device (the gripper mechanism and the bundle position reference member 55*h*) as described above and therefore, such a process as the milling process or the galling process heretofore required during a bookbinding process of many sheets, and particularly during bookbinding by gluing becomes unnecessary, and the downsizing of the bookbinding apparatus can be achieved and also, efficient bookbinding work becomes possible. Also, in the above-described construction, for example, the grippers 53*a*, 53*b* and the small grippers 54*a*, 54*b* constituting a bundle position correcting device for nipping the sheet bundle S1 and performing bundle position correction have also the function of conveying the sheet bundle S1 and therefore, it becomes possible to simplify the construction of the entire apparatus and efficiently realize the downsizing of the apparatus.

According to the present embodiment, the positional accuracy of the sheet bundle and the adhesive applying portion is secured before the application of the adhesive without the milling process being carried out and therefore, an apparatus involved in the milling process, a rubbish treating apparatus for treating the rubbish produced by the milling process and a rubbish collecting container or the like become unnecessary and thus, there can be obtained a bookbinding apparatus and a bookbinding system which are compact and simple in structure.

The present invention will suffice if constructed so that before the application of the adhesive, the state of the adhesive applied surface of the sheet bundle can be corrected so as to be parallel, and the disposition of a constituent member for realizing it, a method of handling the sheet bundle, etc. can be suitably modified.

While the invention has been described with reference to the structure disclosed herein, it is not confined to the details set forth and this application is intended to cover such modifications or changes as may come within the purpose of the improvements or the scope of the following claims.

What is claimed is:

1. A bookbinding apparatus comprising:

an accumulating portion, which accumulates sheets into a sheet bundle;

a holding mechanism, which moves the sheet bundle while holding the sheet bundle in a first holding state or in a second holding state in which a holding force, with which said holding mechanism holds the sheet bundle, is less than a holding force in the first holding state;

a bundle position reference member against which an adhesive applied surface of the sheet bundle, held and moved by said holding mechanism, is rammed in the second holding state in which said holding mechanism holds the sheet bundle;

an adhesive applying portion, which applies an adhesive to the adhesive applied surface of the sheet bundle after the adhesive applied surface of the sheet bundle is rammed against said bundle position reference member by said holding mechanism; and a bookbinding device, which cases the sheet bundle having the adhesive applied thereto in a cover for casing-in a book.

2. A bookbinding apparatus according to claim 1, wherein said holding mechanism has a pair of first nipping members, which nip an upper portion of the sheet bundle overlying an end edge of the sheet bundle to which the adhesive is applied so that the sheet bundle does not rotate, and a pair of second nipping members, which rotatably nip the upper portion of the sheet bundle overlying the end edge of the sheet bundle to which the adhesive is applied.

3. A bookbinding apparatus according to claim 2, further comprising an up and down driving device, which moves up and down said pair of first nipping members, wherein said holding mechanism includes said pair of first nipping members and said up and down driving device.

4. A bookbinding apparatus according to claim 3, further comprising an opening-closing driving device, which opens and closes said pair of first nipping members and said pair of second nipping members, wherein when said pair of first nipping members are opened and said pair of second nipping members are closed, the sheet bundle is rammed against said bundle position reference member by said up and down driving device.

5. A bookbinding system comprising:

a bookbinding apparatus according to any one of claims 1, 2, 3, or 4; and an image forming apparatus attached to said bookbinding apparatus for successively supplying sheets to said accumulating portion.

* * * * *